US010698333B2

(12) United States Patent
Inagaki et al.

(10) Patent No.: US 10,698,333 B2
(45) Date of Patent: Jun. 30, 2020

(54) IMAGE FORMING APPARATUS

(71) Applicant: Konica Minolta, Inc., Tokyo (JP)

(72) Inventors: Yoshihiro Inagaki, Hachioji (JP); Makoto Ooki, Toyohashi (JP); Daisuke Kobayashi, Hino (JP); Kazuki Ikeda, Hachioji (JP); Nurnabila Mohdmakhtar, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/656,130

(22) Filed: Oct. 17, 2019

(65) Prior Publication Data

US 2020/0133157 A1 Apr. 30, 2020

(30) Foreign Application Priority Data

Oct. 31, 2018 (JP) ..... 2018-205661

(51) Int. Cl.
*G03G 15/04* (2006.01)

(52) U.S. Cl.
CPC ..... *G03G 15/04036* (2013.01)

(58) Field of Classification Search
CPC ..... G03G 15/04; G03G 15/04036; G03G 15/04045; G03G 15/04054; G03G 15/04063; G03G 2215/04; G03G 2215/0402; G03G 2215/0407; G03G 2215/0409; G03G 2215/0412
See application file for complete search history.

(56) References Cited

U.S. PATENT DOCUMENTS

2009/0035020 A1* 2/2009 Sowa ..... B41J 2/451 399/218
2010/0124440 A1* 5/2010 Inagaki ..... G03G 15/0435 399/220
2019/0285779 A1* 9/2019 Ooki ..... G02B 3/0056
2019/0310566 A1* 10/2019 Matsuo ..... G02B 27/30

FOREIGN PATENT DOCUMENTS

JP 2009051194 A 3/2009
JP 2010253895 A 11/2010

* cited by examiner

*Primary Examiner* — Thomas S Giampaolo, II
(74) *Attorney, Agent, or Firm* — Lucas & Mercanti, LLP

(57) ABSTRACT

An image forming apparatus includes: a light-emitting element that includes light-emitting point groups; and an optical system that includes imaging systems focusing light from light-emitting points of the light-emitting point groups, wherein the light-emitting point groups and the imaging systems are combined into sets, the light-receiving surface has a cylindrical shape, each imaging system has a negative imaging magnification, light-emitting point groups are arranged at different positions, the imaging systems adjacent to each other have optical axes non-parallel to each other, each optical axis has an angle being not zero relative to the central normal, and a plane including the optical axis and the central normal is perpendicular to a rotational symmetry axis, and an angle between the optical axis and a line normal to the light-receiving surface is smaller than an angle between the central normal and a line normal to the light-receiving surface.

11 Claims, 8 Drawing Sheets

IMAGE FORMING APPARATUS

The entire disclosure of Japanese patent Application No. 2018-205661, filed on Oct. 31, 2018, is incorporated herein by reference in its entirety.

BACKGROUND

Technological Field

The present invention relates to an image forming apparatus including an optical writer, and particularly to an image forming apparatus including a light-emitting element and an optical system that focuses light from a light-emitting point of the light-emitting element on a light-receiving surface.

Description of the Related Art

For example, as described in JP 2009-51194 A, there is a technology in which a plurality of imaging lenses having optical axes parallel to each other is used to focus light from a plurality of light-emitting point groups corresponding to the plurality of imaging lenses to make a drawing. At this time, when an optical system is arranged at different positions in a sub-scanning direction and a photoreceptor has a cylindrical shape, the plurality of optical systems will have an optical system, an optical axis of which does not perpendicularly intersect the photoreceptor. In a case where an optical system is symmetrical in a sub-scanning direction, such as an axially symmetrical optical system, an image plane is symmetrical in the sub-scanning direction and does not match the inclination of a photoreceptor, thus obtaining a non-uniform imaging state. To solve this problem, JP 2010-253895 A describes a method of putting an imaging lens asymmetric with respect to a sub-scanning direction to incline an image plane, but the method may cause a bad imaging state due to side effect caused by the asymmetry.

SUMMARY

An object of the present invention is to provide an image forming apparatus improved in an imaging state also in a sub-scanning direction.

To achieve the abovementioned object, according to an aspect of the present invention, an image forming apparatus reflecting one aspect of the present invention comprises: a light-emitting element that includes light-emitting point groups arranged two-dimensionally; and an optical system that includes imaging systems focusing light from light-emitting points of the light-emitting point groups, on different positions on a light-receiving surface, wherein the light-emitting point groups and the imaging systems are combined into a plurality of sets, the light-receiving surface has a cylindrical shape, each of the imaging systems has a negative imaging magnification, a plurality of light-emitting point groups provided adjacently in a main scanning direction in the light-emitting element is arranged at different positions in the main scanning direction and in a sub-scanning direction corresponding to the main scanning direction, the imaging systems adjacent to each other have optical axes non-parallel to each other having different angles according to positions in the sub-scanning direction when viewed in a direction of a rotation axis of the light-receiving surface, when a central normal passing through the center of each of the light-emitting point groups is not perpendicular to the light-receiving surface, each of the optical axes has an angle being not zero relative to the central normal, and a plane including the optical axis and the central normal is perpendicular to a rotational symmetry axis corresponding to the rotation axis of the light-receiving surface, and an angle between the optical axis and a line normal to the light-receiving surface at the point of intersection between the optical axis and the light-receiving surface is smaller, in absolute value, than an angle between the central normal and a line normal to the light-receiving surface at the point of intersection between the central normal and the light-receiving surface, and the angles are directed in the same direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Hereinafter, a first embodiment of an image forming apparatus according to the present invention will be described with reference to the drawings.

Figure 1:
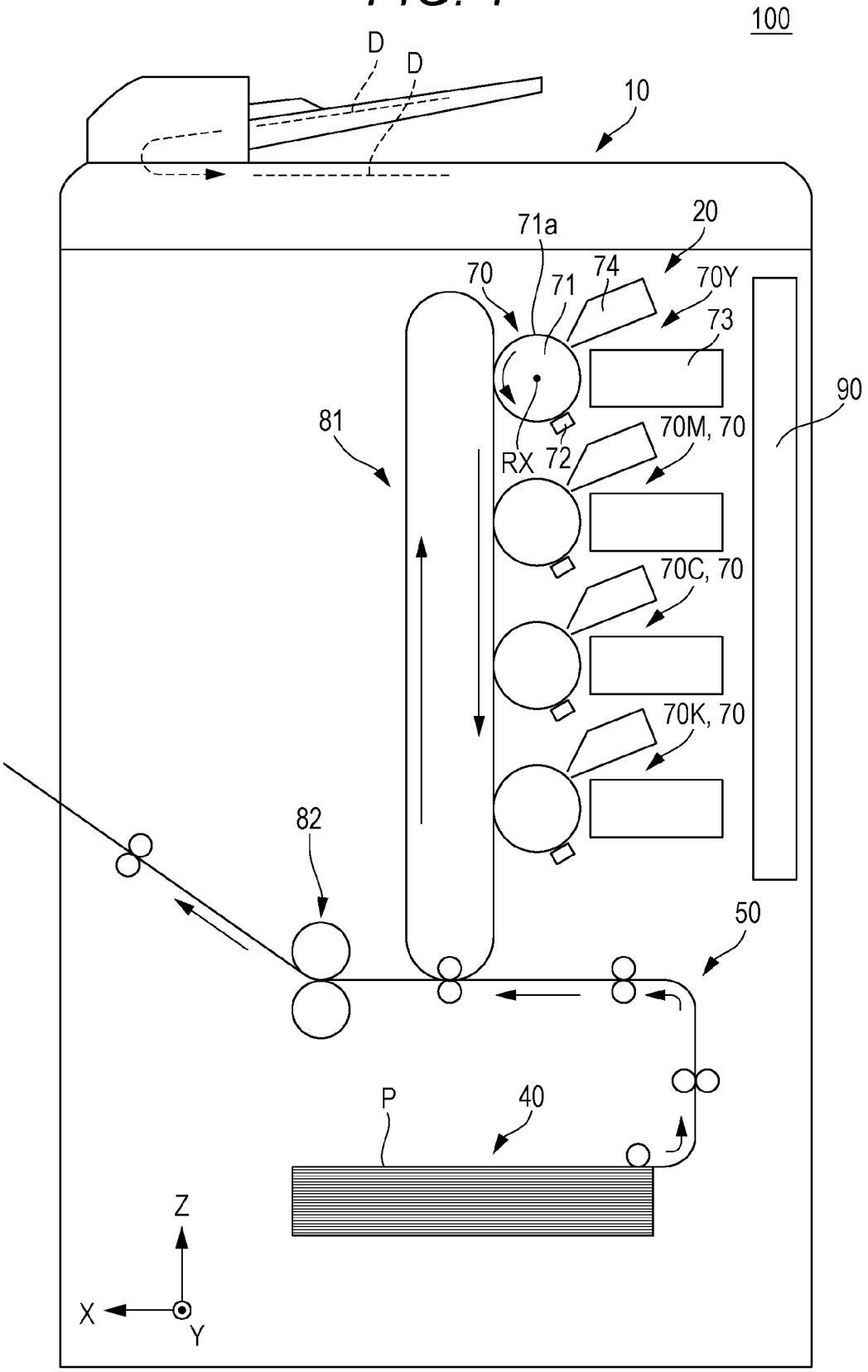
FIG. 1 is a partial cross-sectional view of a schematic configuration of an image forming apparatus according to a first embodiment.

As illustrated in FIG. 1, the image forming apparatus 100 according to the present embodiment is used as, for example, a digital copying machine and includes an image reader 10 that reads a color image formed on a document D, an image former 20 that forms an image corresponding to the document D on a paper sheet P, a paper feeder 40 that feeds a paper sheet P to the image former 20, a sheet feeder 50 that transports a paper sheet P, and a controller 90 that integrally controls operation of the whole image forming apparatus.

The image former 20 includes image forming units 70Y, 70M, 70C, and 70K that are provided for colors of cyan, magenta, yellow, and black, an intermediate transfer unit 81 that forms a toner image having colors combined, and a fuser 82 that fuses the toner image.

The image forming unit 70Y of the image former 20 is a portion that forms a Y (yellow) color image and includes a photoreceptor drum 71, a charger 72, an optical print head (optical writer) 73, a development unit 74, and the like. The photoreceptor drum 71 forms a Y color toner image, and the charger 72 is arranged around the photoreceptor drum 71 to charge a surface of the photoreceptor drum 71 by corona discharge, the optical print head 73 emits light corresponding to a Y color component image to the photoreceptor drum 71, and the development unit 74 applies Y color component toner to the surface of the photoreceptor drum 71 to form a toner image from an electrostatic latent image. The photoreceptor drum 71 has a cylindrical shape and rotates around a rotation axis RX. The photoreceptor drum 71 has a cylindrical surface formed as a light-receiving surface 71*a* that focuses light from the optical print head 73.

The other image forming units 70M, 70C, and 70K have the same structure and function as those of the image forming unit 70Y for Y color, except that the images to be formed are different in color, and thus the description thereof will be omitted. Note that the image forming unit 70 represents any appropriate unit of the image forming units 70Y, 70M, 70C and 70K of four colors and includes, as elements adapted to the corresponding color, the photoreceptor drum 71, the charger 72, the optical print head 73 and the development unit 74.

Figure 2A:
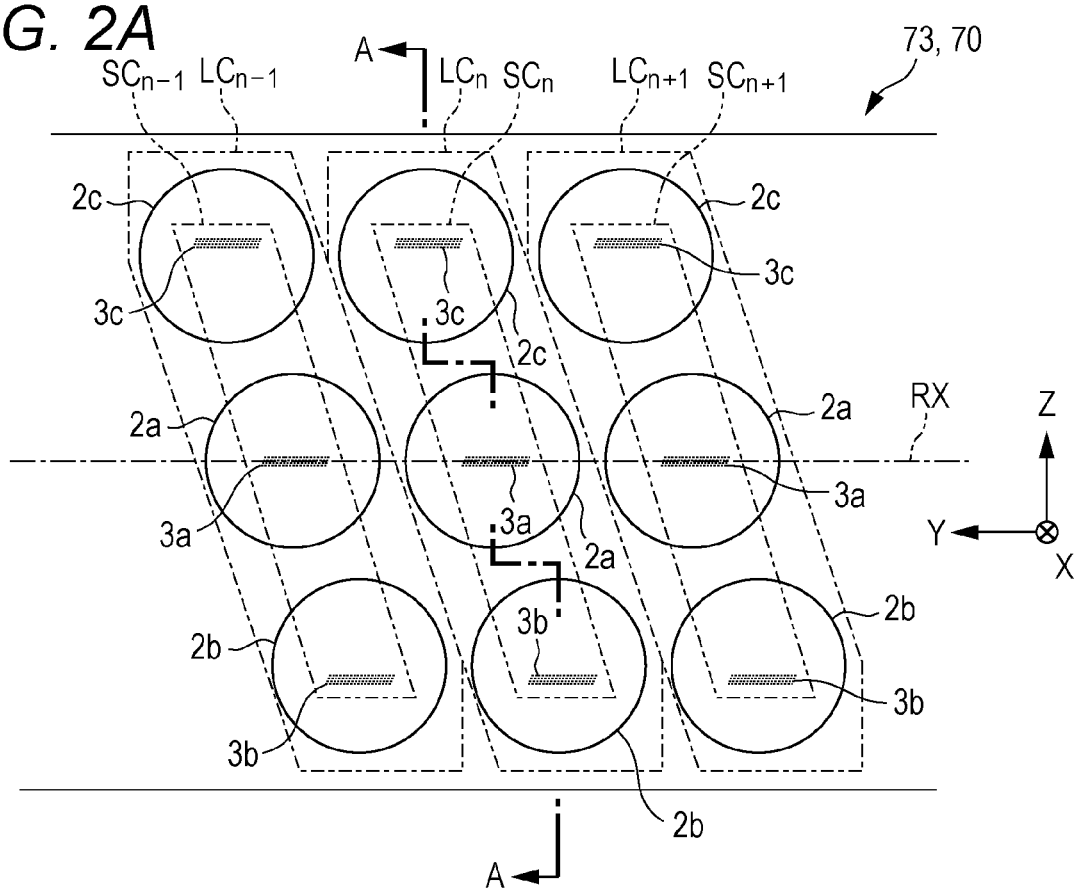
FIG. 2A is a conceptual diagram illustrating a front side of a structure of an optical print head constituting an image forming unit.
Figure 2B:
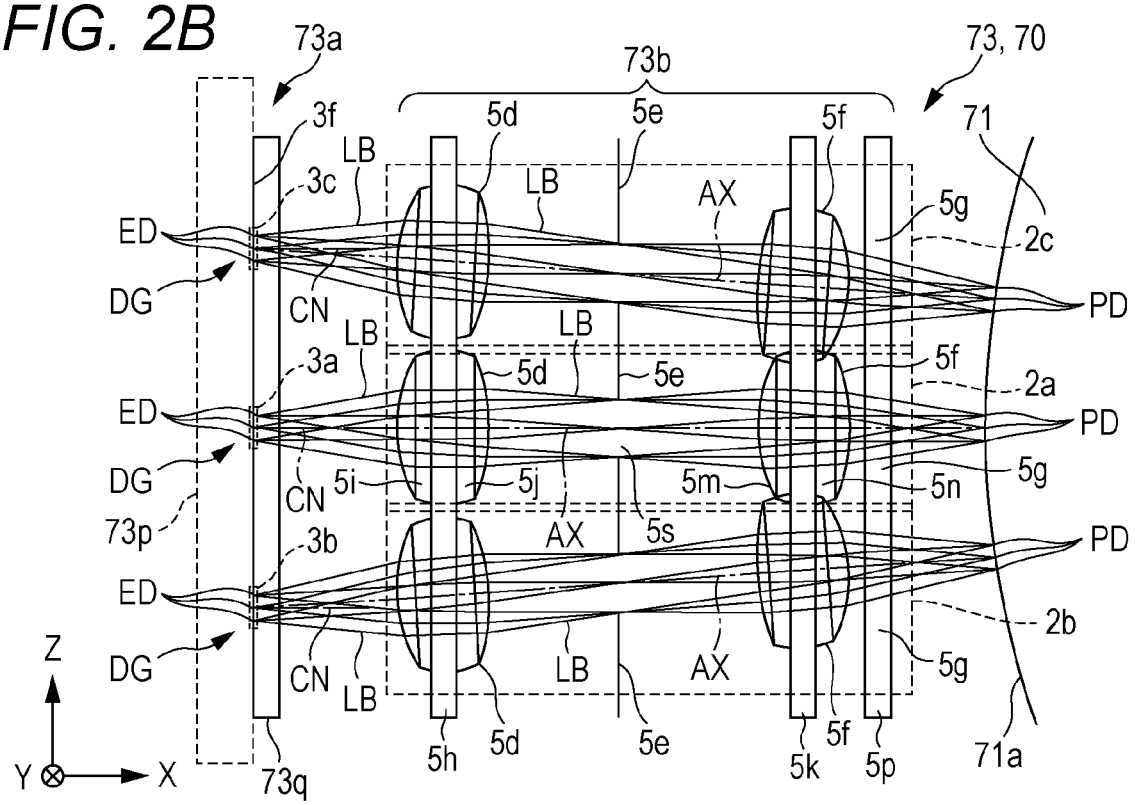
FIG. 2B is a side view of the optical print head taken along the line A-A of FIG. 2A.

FIG. 2A is a conceptual diagram illustrating a front side of a structure of the optical print head (optical writer) 73 of the image forming unit 70 illustrated in FIG. 1, and FIG. 2B is a side view of the optical print head 73. FIG. 2A is a front view of the photoreceptor drum 71, as viewed from the rotation axis RX of the photoreceptor drum 71. The optical print head 73 includes a light-emitting element 73*a* that includes light-emitting areas 3*a*, 3*b*, and 3*c* each having a light-emitting point group DG and two-dimensionally arranged, and an optical system 73*b* that has imaging systems 2*a*, 2*b*, and 2*c* for focusing light from light-emitting points ED of the light-emitting point groups DG on different positions on the light-receiving surface 71*a*. Here, the Y axis parallel to the rotation axis RX of the photoreceptor drum 71 corresponds to a main scanning direction, and the Z axis orthogonal to the rotation axis RX of the photoreceptor drum 71 and extending perpendicular to an optical axis AX of the light-emitting area 3*a* at the center corresponds to a sub-scanning direction. Light emission timing of each of the light-emitting points ED constituting each of the light-emitting point groups DG is synchronized with the rotation angle of the photoreceptor drum 71 under the control of the controller 90.

The light-emitting element 73*a* as a light source includes a bottom emission organic EL having light-emitting points two-dimensionally arranged on a glass plate. Three light-emitting areas 3*a*, 3*b*, and 3*c* are arranged in the sub-scanning direction and correspond to the imaging systems 2*a*, 2*b*, and 2*c*. The imaging systems 2*a*, 2*b*, and 2*c* being positioned by a holder, not illustrated, are fixedly positioned with respect to the light-emitting element 73*a*.

In the light-emitting element 73*a*, a light-emitting set $SC_n$ (n=1, 2, 3, . . . ) having a set of three adjacent light-emitting areas 3*a*, 3*b*, and 3*c* is repeatedly arranged at equal intervals in a Y direction. The light-emitting areas 3*a*, 3*b*, and 3*c* constituting the light-emitting set $SC_n$ are arranged at different positions in the main scanning direction or Y direction and further arranged at different positions in the sub-scanning direction or Z direction. Similarly, in the optical system 73*b*, an imaging set $LC_n$ (n=1, 2, 3, . . . ) having a set of three adjacent imaging systems 2*a*, 2*b*, and 2*c* is repeatedly arranged at equal intervals in the Y direction. The imaging systems 2*a*, 2*b*, and 2*c* constituting the imaging set $LC_n$ are arranged at different positions in the main scanning direction or Y direction, and further arranged at different positions in the sub-scanning direction or Z direction.

The light-emitting element 73*a* includes a device body 73*p* in which the light-emitting areas 3*a*, 3*b*, and 3*c* are provided on a surface side and a glass substrate 73*q* that covers the light-emitting areas 3*a*, 3*b*, and 3*c*. The light-emitting areas 3*a*, 3*b*, and 3*c* are provided on a common light-emitting surface 3*f* of the device body 73*p*.

In the optical system 73*b*, each of the imaging systems 2*a*, 2*b*, and 2*c* includes a first lens 5*d*, an aperture stop 5*e*, a second lens 5*f*, and a flat plate 5*g*. The first lens 5*d* is a convex lens, and in the illustrated example, lens portions 5*i* and 5*j* made of resin are formed on both sides of a common lens substrate 5*h* made of glass or the like. The first lens 5*d* collimates light beams LB from the light-emitting area 3*a*. The aperture stop 5*e* is formed by defining an opening 5*s* in a light shield. The second lens 5*f* is a convex lens, and in the illustrated example, lens portions 5*m* and 5*n* made of resin are formed on both sides of a common lens substrate 5*k* made of glass or the like. The second lens 5*f* focuses the light beams LB from the first lens 5*d* to form a projection image PD having the same pattern as that of the light-emitting points ED on the light-receiving surface 71*a* of the photoreceptor drum 71. The flat plate 5*g* corresponds to a protective cover 5*p*, covers the three imaging systems 2*a*, 2*b*, and 2*c* together with an exterior, not illustrated, and protects the inside of the optical print head 73 from dust, dirt, or the like.

As is apparent from FIG. 2B, the imaging system 2*a* at the center of the three imaging systems 2*a*, 2*b*, and 2*c* in the figure has an optical axis AX which is perpendicular to the light-emitting surface 3*f* and is also perpendicular to the light-receiving surface 71*a* of the photoreceptor drum 71. On the other hand, the imaging systems 2*b* and 2*c* on the upper and lower sides have optical axes AX which have an angle not parallel to the optical axis AX of the imaging system 2*a* at the center, not perpendicular to the light-emitting surface 3*f*, and not perpendicular to the light-receiving surface 71*a*. More specifically, the optical axis AX of the imaging system 2*a* at the center of the optical system 73*b* extends parallel to the X-axis direction orthogonal to the main scanning direction and the sub-scanning direction. Here, when considering a central normal CN extending perpendicularly to the light-emitting surface 3*f* through the center of the light-emitting point group DG of the light-emitting area 3*a* at the center, the central normal CN extends in line with the optical axis AX, and the central normal CN intersects the light-receiving surface 71*a* perpendicularly. Furthermore, the optical axis AX of the imaging system 2*b* on the lower side of the optical system 73*b* is inclined to turn counterclockwise in the X-axis direction orthogonal to the main scanning direction and the sub-scanning direction and is inclined to move to the upper side or the positive Z side, toward the photoreceptor drum 71 or the positive X side.

Here, when considering a central normal CN extending perpendicularly to the light-emitting surface 3*f* through the center of the light-emitting point group DG of the light-emitting area 3*b* on the lower side, the central normal CN does not intersect the light-receiving surface 71*a* perpendicularly. On the other hand, the optical axis AX of the imaging system 2*c* on the upper side of the optical system 73*b* is inclined to turn clockwise in the X-axis direction orthogonal to the main scanning direction and the sub-scanning direction and is inclined to move to the lower side or the negative Z side, toward the photoreceptor drum 71 or the positive X side. Here, when considering a central normal CN extending perpendicularly to the light-emitting surface 3*f* through the center of the light-emitting point group DG of the light-emitting area 3*c* on the upper side, the central normal CN does not intersect the light-receiving surface 71*a* perpendicularly. As described above, when viewed from the rotation axis RX, the optical axes AX of three adjacent imaging systems 2*a*, 2*b*, and 2*c* are not parallel to each other, having different angles depending on the position in the sub-scanning direction Z. Thus, when the central normal CN does not intersect the light-receiving surface 71*a* perpendicularly, that is, in the imaging systems 2*b* and 2*c*, each optical axis AX has an angle not being zero relative to the central normal CN, but an XZ plane including the optical axis AX and the central normal CN extends perpendicularly to the rotation axis RX as the rotational symmetry axis of the light-receiving surface 71*a*.

Figure 3A:
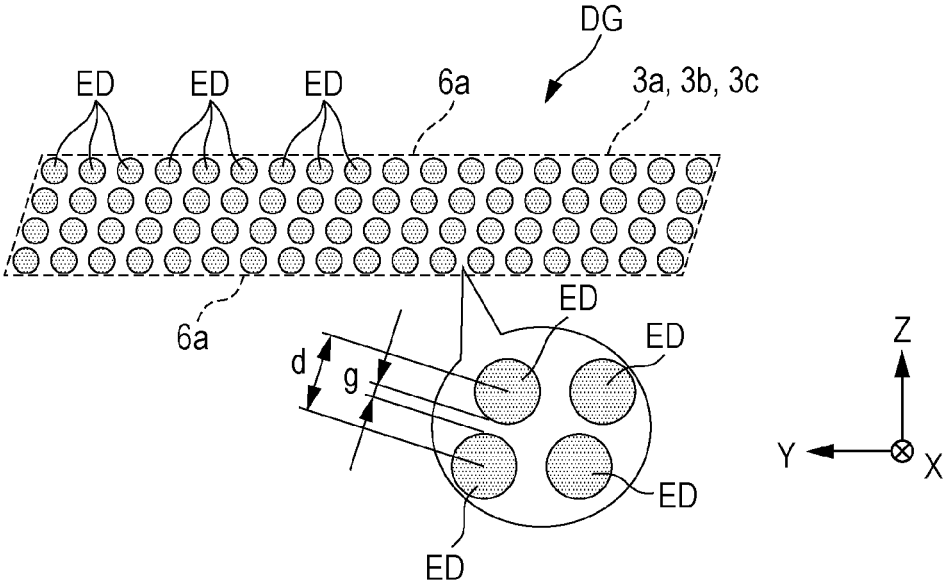
FIG. 3A is a diagram illustrating light-emitting point groups provided in a light-emitting element of the optical print head illustrated in FIG. 2A.

FIG. 3A is an enlarged view illustrating the arrangement of a light-emitting point group DG or light-emitting points ED arranged in a single light-emitting area 3*a*. In the drawing, the vertical direction represents the sub-scanning direction, and the horizontal direction represents the main scanning direction. In this case, the light-emitting point group DG is arranged in a parallelogram light-emitting area 3*a* to be aligned with the opposite sides of the parallelogram. The light-emitting point group DG includes the light-emitting points ED which are arranged at equal intervals in a Y direction corresponding to the main scanning direction and in a Z direction corresponding to the sub-scanning direction. The opposite sides 6*a* on the upper and lower sides corresponding to a longitudinal direction of the parallelogram of the light-emitting area 3*a* extend in parallel to the Y direction corresponding to the main scanning direction and further extends also parallel to the rotation axis RX as the rotational symmetry axis of the light-receiving surface 71*a*, not illustrated.

Figure 3B:
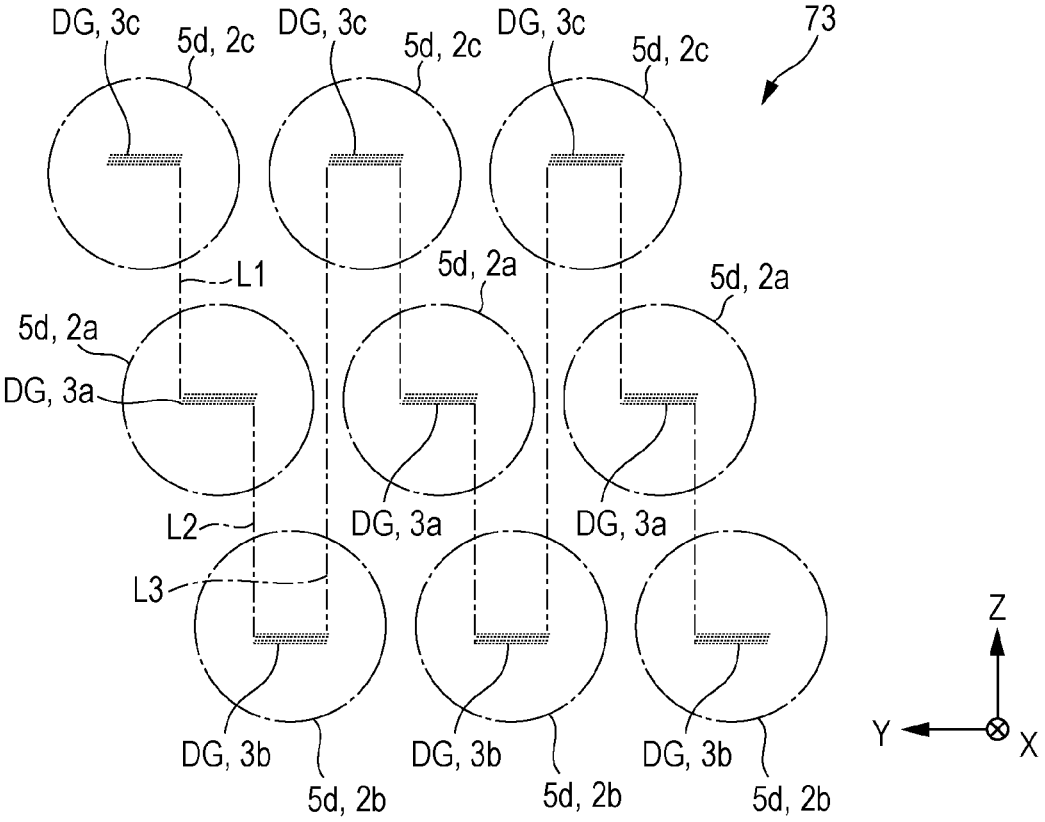
FIG. 3B is a diagram illustrating arrangement of the light-emitting point groups and lenses.

FIG. 3B illustrates the light-emitting point groups DG and the outer shapes of the first lenses 5*d* positioned closer to the light source. Although nine light-emitting point groups DG and first lenses 5*d* are illustrated in this figure, arrangement repeated on the left and right sides in the main scanning directions is omitted, and the optical system 73*b* includes a total of 231 first lenses 5*d* or imaging systems 2*a*, 2*b*, and 2*c*. Each of the light-emitting point groups DG is arranged around a position where the optical axis AX of each of the imaging systems 2*a*, 2*b*, and 2*c* intersects the light-emitting surface 3*f* (see FIG. 2B). As previously illustrated in FIG. 2B, since the optical axes AX of the imaging systems 2*a* and 2*c* on the upper and lower sides are not perpendicular to the light-emitting surface 3*f*, though the light-emitting point groups DG and the imaging systems 2*a*, 2*b*, and 2*c* are centered on the optical axes AX, the imaging systems 2*a*, 2*b*, and 2*c* appear to be shifted inward in the figure. Note that auxiliary lines L1 to L3 indicate that the light-emitting point groups DG constituting the light-emitting areas 3*a*, 3*b*, and 3*c* are continuously connected in the main scanning direction.

Figure 4A:
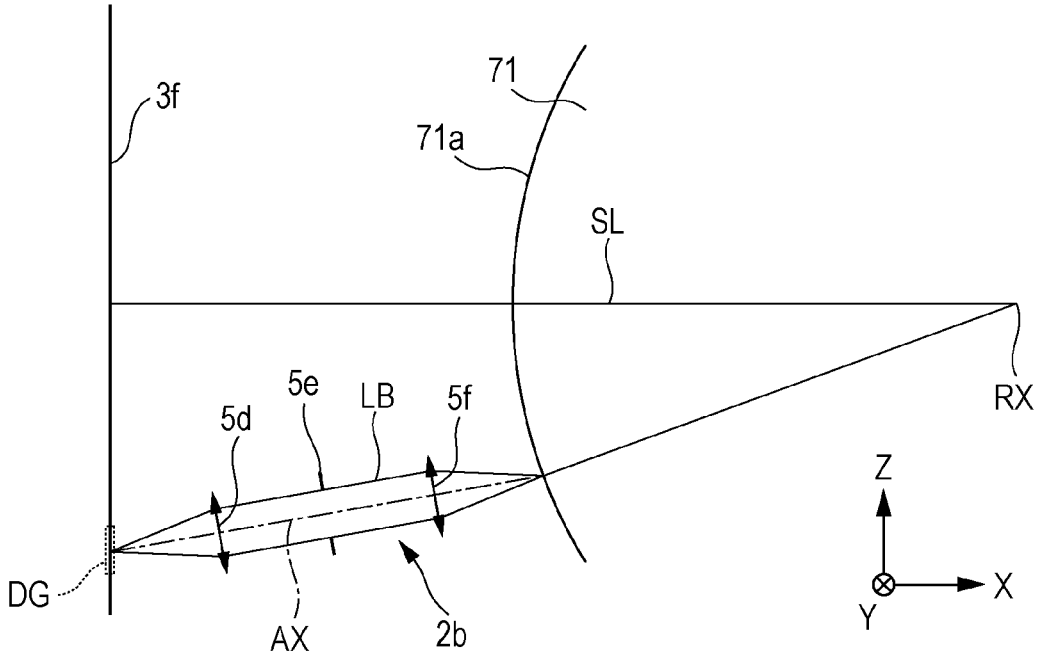
FIGS. 4A and 4B are conceptual diagrams each illustrating an optical system of the optical print head.
Figure 4B:
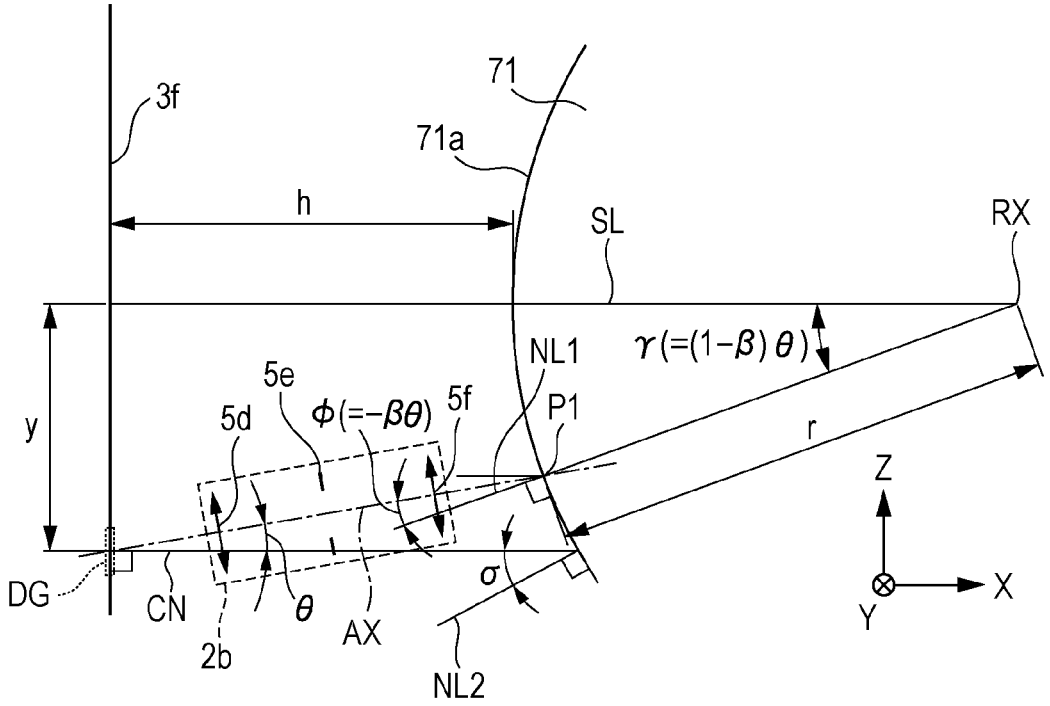

FIG. 4A is a schematic diagram illustrating inclination and the like of the optical axis AX of the imaging system 2*b* of the optical system 73*b* illustrated in FIG. 2B and the like, and FIG. 4B is a diagram illustrating angular relationships and dimensions of each portion illustrated in FIG. 4A. In this case, a description of the imaging system 2*a* in which the optical axis AX intersects perpendicularly to the light-receiving surface 71*a* of the photoreceptor drum 71 is omitted, and a description of the imaging system 2*c* obtained by inverting the imaging system 2*b* is also omitted. Note that a reference line SL corresponds to the optical axis AX of the imaging system 2*a*, extends in the X direction, and passes through the rotation axis RX, being the rotational symmetry axis, of the light-receiving surface 71*a*.

For the imaging system 2*b*, the optical axis AX can be inclined so as to satisfy the following relational expression (R1)

$$\theta = y/(h+(1-\beta)r) \quad \text{(R1)}$$

to make the inclination of the light-receiving surface 71*a* coincide exactly with the inclination of an image plane according to the imaging system 2*b*. Here, the value θ represents an angle between a line normal to a flat surface (corresponding to the light-emitting surface 3*f*) formed by the light-emitting point group DG and the optical axis AX of the imaging system 2*b*. The value y represents a distance from a foot of the line extending from the rotational symmetry axis (rotation axis RX) and normal to the flat surface (corresponding to the light-emitting surface 3*f*) formed by the light-emitting point group DG, to a position at which the optical axis AX intersects the flat surface (corresponding to the light-emitting surface 3*f*) formed by the light-emitting point group DG, in an XZ plane perpendicular to the rotational symmetry axis (rotation axis RX) of the light-receiving surface 71*a*. The value h represents a distance, in the reference line SL or the line extending from the rotational symmetry axis (rotation axis RX) and normal to the flat surface (corresponding to the light-emitting surface 3*f*) formed by the light-emitting point group DG, from a position where the line intersects the light-receiving surface 71*a* to a position where the line intersects the flat surface (corresponding to the light-emitting surface 3*f*) formed by the light-emitting point group DG. The value β represents an imaging magnification of the imaging system 2*b*, and the value r represents a radius of the cylindrical shape of the light-receiving surface 71*a*. Note that an optimal condition is satisfied when an angle φ at which the optical axis AX of the imaging system 2*b* intersects the light-receiving surface 71*a* is equal to the product of the inclination θ of the optical axis AX multiplied by the absolute value of the imaging magnification β.

Actually, it is not necessary to make the inclination of the optical axis AX of the imaging system 2*b* coincide with the relational expression (R1), and when the optical axis AX perpendicular to the flat surface (corresponding to the light-emitting surface 3*f*) formed by the light-emitting point group DG is inclined in a direction in which an incident angle to the light-receiving surface 71*a* decreases and at an angle smaller than that of normal incidence on the light-receiving surface 71*a*, a certain degree of effect is obtained. In other words, the angle φ between the optical axis AX of the imaging system 2*b* and a line NL1 normal to the light-receiving surface 71*a* at a point P1 of intersection between the optical axis AX of the imaging system 2*b* and the light-receiving surface 71*a* is adjusted to be smaller, in absolute value, than the angle σ between the central normal CN and a line NL2 normal to the light-receiving surface 71*a* at a point P2 of intersection between the central normal CN and the light-receiving surface 71*a*, and the angles are adjusted to be directed in the same direction. Thus, a difference between the inclination of the light-receiving surface 71*a* and the inclination of the image plane according to the imaging system 2*b* can be reduced.

In addition, when the optical axis AX of the imaging system 2*b* is inclined in the range of plus or minus 10% of the angle θ optimally given by formula (1), and a practical effect is sufficiently obtained. In other words, an actual inclination angle θ of the optical axis AX of the imaging system 2*b* is preferably set to satisfy the following conditional expressions (1) or (2):

$$0.90 \le y/(h+(1-\beta)r) \le 1.1\theta \quad (1)$$

$$0.9 \le y/(h+(1-\beta)r)/\theta \le 1.1 \quad (2)$$

Although a description has been omitted above, also for the imaging system 2*c*, the same conditions as those of the imaging system 2*b* are desirably satisfied. In other words, the angle φ between the optical axis AX of the imaging system 2*c* and a line normal to the light-receiving surface 71*a* at a point of intersection between the optical axis AX of the imaging system 2*c* and the light-receiving surface 71*a* is adjusted to be smaller, in absolute value, than an angle σ between the central normal CN and a line normal to the light-receiving surface 71*a* at a point of intersection between the central normal CN and the light-receiving surface 71*a*, and the angles are adjusted to be directed in the same direction.

Each of the imaging systems 2*b* and 2*c* is an optical system having symmetry in the sub-scanning direction. Each of the imaging systems 2*b* and 2*c* is, for example, a rotationally symmetric optical system and specifically, can be constituted by an aspheric surface. Each of the imaging systems 2*b* and 2*c* is, for example, an optical system being symmetrical about two orthogonal planes and specifically, can be constituted by a free-form surface. In this case, a sagittal image plane is made to coincide with a meridional image plane.

According to the image forming apparatus 100 of the first embodiment described above, when viewed from the rotation axis RX, the optical axes AX of adjacent imaging systems 2*a* to 2*c* are not parallel to each other to have different angles depending on the position in the sub-scanning direction or the Z direction, symmetry of the adjacent imaging systems 2*a* to 2*c* in the sub-scanning direction is increased, and a preferable imaging state of each imaging system is provided. Furthermore, the angle φ between the optical axis AX of each of the inclined imaging systems 2*b* and 2*c* and a line NL1 normal to the light-receiving surface 71*a* at a point P1 of intersection between the optical axis AX of each of the inclined imaging system 2*b* and 2*c* and the light-receiving surface 71*a* is smaller, in absolute value, than the angle σ between the central normal CN and a line NL2 normal to the light-receiving surface 71*a* at a point P2 of intersection between the central normal CN and the light-receiving surface 71*a*, the angles are directed in the same direction, and thus, excessively large angle between the optical axis AX and the line NL1 normal to the light-receiving surface 71*a*, and large inclination with respect to the light-receiving surface 71*a* of the image plane are prevented, maintaining a good imaging state.

EXAMPLES

Hereinafter, specific examples of the optical system 73*b* incorporated in the image forming apparatus according to the present invention will be described.

First Example

[1-a: Imaging System at Center]

Data on the imaging system 2*a* at the center will be described below. Table 1 summarizes coordinates of surface vertices of optical surfaces constituting the imaging system 2*a* at the center. The unit of distance is mm.

TABLE 1

| | X | Y | Z | Angle |
|---|---|---|---|---|
| Light-emitting point group | 0.000 | 0.000 | 0.000 | 0.000 |
| Emission surface of substrate | 0.700 | 0.000 | 0.000 | 0.000 |
| Front surface of first lens | 3.941 | 0.000 | 0.000 | 0.000 |
| Lens substrate 1 | 4.841 | 0.000 | 0.000 | 0.000 |
| | 5.541 | 0.000 | 0.000 | 0.000 |
| Back surface of first lens | 6.441 | 0.000 | 0.000 | 0.000 |
| Aperture stop | 10.000 | 0.000 | 0.000 | 0.000 |
| Front surface of second lens | 13.759 | 0.000 | 0.000 | 0.000 |
| Lens substrate 2 | 14.659 | 0.000 | 0.000 | 0.000 |
| | 15.359 | 0.000 | 0.000 | 0.000 |
| Back surface of second lens | 16.259 | 0.000 | 0.000 | 0.000 |
| Protective cover | 16.700 | 0.000 | 0.000 | 0.000 |
| | 17.400 | 0.000 | 0.000 | 0.000 |
| Light-receiving surface | 20.000 | 0.000 | 0.000 | 0.000 |

Aspheric shapes in the imaging system 2*a* are summarized in Table 2. Aspheric surfaces described in Table 2 are all axisymmetric aspherical surfaces, having no spherical term, and a shape formula is expressed as follows, with local coordinates corresponding to X, Y, Z as x, y, z.

$$x = \Sigma_i a_i (y^2 + z^2)^{\frac{1}{2}}$$

Note that aspheric coefficients $a_i$ not shown in the table are all zero. Hereinafter the same shall apply.

TABLE 2

| i | Aspheric coefficient |
|---|---|
| Front surface of first lens 5d | |
| 2 | 1.20487E−01 |
| 4 | 1.27200E−03 |
| 6 | −7.26520E−04 |
| 8 | 5.46414E−04 |
| 10 | −8.62537E−05 |
| Back surface of first lens 5d | |
| 2 | −1.09534E−01 |
| 4 | 5.48658E−03 |
| 6 | −1.45499E−03 |
| 8 | 9.07461E−04 |
| 10 | −1.45714E−04 |
| Front surface of second lens 5f | |
| 2 | 1.34653E−01 |
| 4 | −2.01886E−03 |
| 6 | 1.22978E−03 |

TABLE 2-continued

| i | Aspheric coefficient |
|---|---|
| 8 | −5.45641E−04 |
| 10 | 8.74909E−05 |
| Back surface of second lens 5f | |
| 2 | −9.44828E−02 |
| 4 | 1.73989E−03 |
| 6 | 1.09346E−03 |
| 8 | −6.06572E−04 |
| 10 | 1.09095E−04 |

[1-b: Imaging System on Lower Side]

Hereinafter, data on the imaging system 2*b* on the lower side will be described. Table 3 summarizes coordinates of surface vertices of optical surfaces constituting the imaging system 2*b* on the lower side.

TABLE 3

| | X | Y | Z | Angle |
|---|---|---|---|---|
| Light-emitting point group | 0.000 | −1.228 | −4.966 | 0.000 |
| Emission surface of substrate | 0.700 | 0.000 | 0.000 | 0.000 |
| Front surface of first lens | 3.941 | −1.228 | −4.701 | −4.086 |
| Lens substrate 1 | 4.841 | 0.000 | 0.000 | 0.000 |
| | 5.541 | 0.000 | 0.000 | 0.000 |
| Back surface of first lens | 6.435 | −1.228 | −4.523 | −4.086 |
| Aperture stop | 10.000 | −1.228 | −4.269 | 0.000 |
| Front surface of second lens | 13.759 | −1.228 | −4.000 | −4.086 |
| Lens substrate 2 | 14.659 | 0.000 | 0.000 | 0.000 |
| | 15.359 | 0.000 | 0.000 | 0.000 |
| Back surface of second lens | 16.252 | −1.228 | −3.822 | −4.086 |
| Protective cover | 16.700 | 0.000 | 0.000 | 0.000 |
| | 17.400 | 0.000 | 0.000 | 0.000 |
| Light-receiving surface | 20.254 | −1.228 | −3.553 | −8.171 |

Aspheric shapes in the imaging system 2*b* are summarized in Table 4.

TABLE 4

| i | Aspheric coefficient |
|---|---|
| Front surface of first lens 5d | |
| 2 | 1.20105E−01 |
| 4 | 1.03155E−03 |
| 6 | −5.01766E−04 |
| 8 | 4.35115E−04 |
| 10 | −6.79071E−05 |
| Back surface of first lens 5d | |
| 2 | −1.09187E−01 |
| 4 | 5.13509E−03 |
| 6 | −1.12857E−03 |
| 8 | 7.36561E−04 |
| 10 | −1.15787E−04 |
| Front surface of second lens 5f | |
| 2 | 1.04644E−01 |
| 4 | −5.13799E−03 |
| 6 | 1.12064E−05 |
| 8 | −2.22537E−04 |
| 10 | 1.88314E−05 |
| Back surface of second lens 5f | |
| 2 | −1.23420E−01 |
| 4 | −1.34134E−03 |
| 6 | −1.18643E−04 |
| 8 | −1.70762E−04 |
| 10 | 2.18693E−05 |

An optical system according to a first example is similar to the optical system illustrated in FIG. 2B. In the imaging system 2*b* on the lower side, surface vertexes have different values in both the X axis and the Z axis, but the four lens surfaces and the aperture stop are arranged in line along the optical axis AX. In contrast, flat plates, such as the lens substrates 5*h* and 5*k* and the protective cover 5*p*, have coordinates in common with those of the imaging system 2*a* at the center. The light-emitting point group DG of the imaging system 2*b* on the lower side is located in a plate common to that of the imaging system 2*a* at the center, but the table shows the coordinates of the center of the light-emitting point group DG. Furthermore, the light-receiving surface 71*a* corresponding to a photoreceptor has a cylindrical shape having a radius of 25 mm and has a plate also common to that of the imaging system 2*a* at the center, but the table shows the position and inclination at a position where the light-receiving surface 71*a* intersects the optical axis AX of the imaging system 2*b*. Note that the lens substrates have a refractive index of 1.5145 at a wavelength of 650 nm, and a resin between a lens surface and the glass substrate has a refractive index of 1.5285. Furthermore, both the optical system at the center and the optical system on the lower side have an imaging magnification β of −1.

In the first example, a single light-emitting point ED has a diameter of 60 μm, and light-emitting points ED have a minimum interval g of 10 μm and a minimum center distance d of 70 μm. In a horizontal direction, the light-emitting points ED are arranged at a pitch of 21.2 μm corresponding to one dot at 1200 dpi, and the light-emitting points ED having a larger diameter are arranged to be gradually shifted in the Z direction corresponding to the sub-scanning direction into four rows so that the light-emitting points ED do not overlap each other. One row extending in the Y direction corresponding to the main scanning direction has 18 light-emitting points ED, and a total of 72 light-emitting points are arranged into a parallelogram. When viewed at the center of the light-emitting point ED, the width in the main scanning direction is 1503 μm, and the width in the sub-scanning direction is 200 μm. Since the light-emitting point has a diameter of 60 μm, the full width is 1563 μm in the main scanning direction and 260 μm in the sub-scanning direction.

Figure 5A:
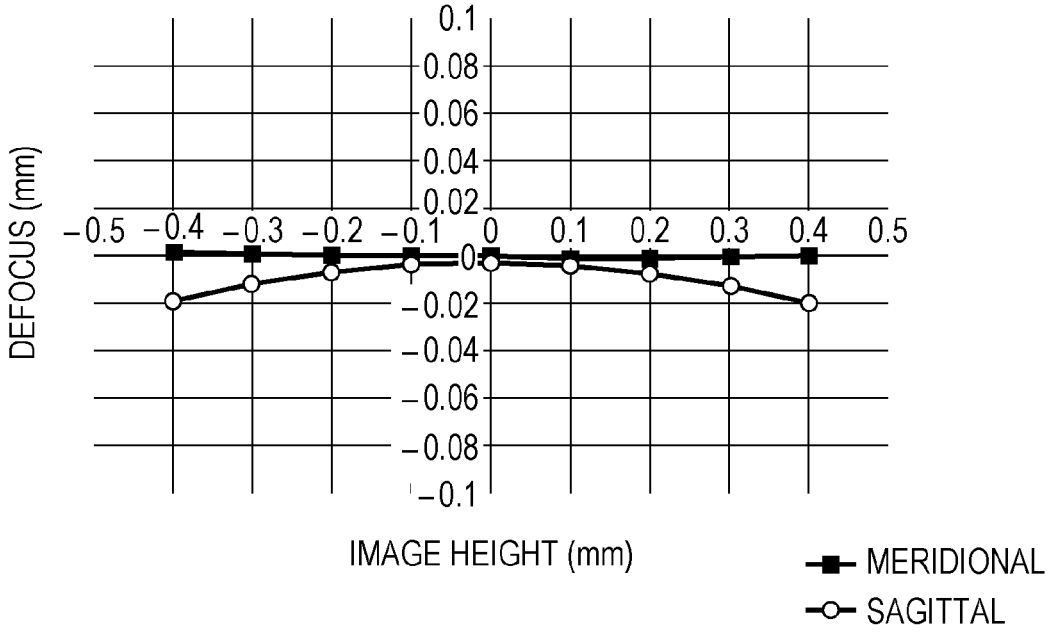
FIG. 5A illustrates field curvature in an imaging system on the lower side according to a first example.
Figure 5B:
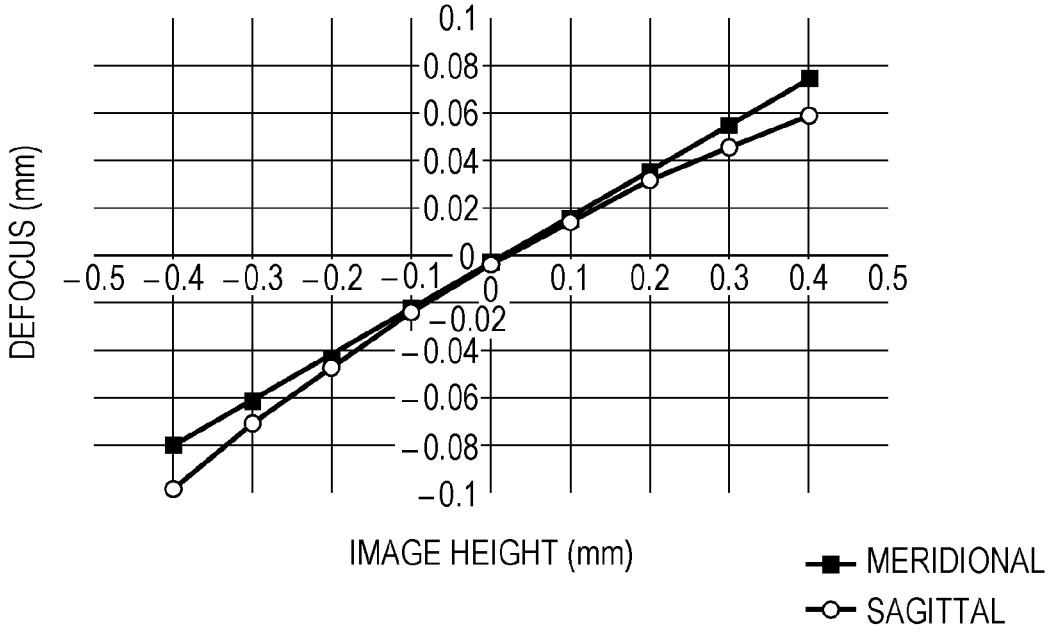
FIG. 5B illustrates field curvature in an imaging system on the lower side according to a comparative example.

FIG. 5A illustrates field curvature in the imaging system 2*b* on the lower side according to the first example, and FIG. 5B illustrates field curvature in the imaging system on the lower side according to a comparative example. Image height on the horizontal axis represents image height in the sub-scanning direction. Note that although no illustration is made, the imaging system on the lower side of the comparative example has a configuration similar to that of the imaging system at the center, but the optical axis of the imaging system on the lower side of the comparative example is parallel to the optical axis of the imaging system at the center. In other words, the optical axis of the imaging system on the lower side of the comparative example is not inclined relative to the light-emitting surface 3*f* corresponding to the light source surface but inclined relative to the light-receiving surface 71*a* corresponding to a photosensitive surface. The inclination of the optical axis of the imaging system on the lower side of the comparative example relative to the light-receiving surface 71*a* is approximately 11.3 degrees. As illustrated in FIG. 5A, in the imaging system 2*b* on the lower side of first example, there is separation between the sagittal image plane and the meridional image plane, but there is no inclination in the image planes. As illustrated in FIG. 5B, in the comparative example, there is an inclination in the sagittal and meridional image planes. In other words, since the image plane is symmetrical about the optical axis, the image plane is inclined when viewed with respect to the inclined light-receiving surface 71*a*.

Second Example

[2-a: Imaging System at Center]

Data on the imaging system 2*a* at the center will be described below. Table 5 summarizes coordinates of surface vertices of optical surfaces constituting the imaging system 2*a* at the center.

TABLE 5

| | X | Y | Z | Angle |
|---|---|---|---|---|
| Light-emitting point group | 0.000 | 0.000 | 0.000 | 0.000 |
| Emission surface of substrate | 0.700 | 0.000 | 0.000 | 0.000 |
| Front surface of first lens | 5.271 | 0.000 | 0.000 | 0.000 |
| Lens substrate 1 | 6.171 | 0.000 | 0.000 | 0.000 |
| | 6.871 | 0.000 | 0.000 | 0.000 |
| Back surface of first lens | 7.771 | 0.000 | 0.000 | 0.000 |
| Aperture stop | 12.500 | 0.000 | 0.000 | 0.000 |
| Front surface of second lens | 16.323 | 0.000 | 0.000 | 0.000 |
| Lens substrate 2 | 17.223 | 0.000 | 0.000 | 0.000 |
| | 17.923 | 0.000 | 0.000 | 0.000 |
| Back surface of second lens | 18.823 | 0.000 | 0.000 | 0.000 |
| Protective cover | 19.300 | 0.000 | 0.000 | 0.000 |
| | 20.000 | 0.000 | 0.000 | 0.000 |
| Light-receiving surface | 22.500 | 0.000 | 0.000 | 0.000 |

Aspheric shapes in the imaging system 2*a* are summarized in Table 6.

TABLE 6

| i | Aspheric coefficient |
|---|---|
| Front surface of first lens 5d | |
| 2 | 9.43657E−02 |
| 4 | −8.65641E−05 |
| 6 | −8.42627E−04 |
| 8 | 6.26133E−04 |
| 10 | −1.30903E−04 |
| Back surface of first lens 5d | |
| 2 | −8.57870E−02 |
| 4 | 1.36998E−03 |
| 6 | −7.32714E−04 |
| 8 | 6.25481E−04 |
| 10 | −1.39536E−04 |
| Front surface of second lens 5f | |
| 2 | 1.23764E−01 |
| 4 | 3.19805E−05 |
| 6 | 9.94537E−06 |
| 8 | −5.65510E−04 |
| 10 | 1.76241E−04 |
| Back surface of second lens 5f | |
| 2 | −1.06345E−01 |
| 4 | 3.38764E−03 |
| 6 | 1.20104E−04 |
| 8 | −7.96227E−04 |
| 10 | 2.53195E−04 |

[2-b: Imaging System on Lower Side]

Hereinafter, data on the imaging system 2*b* on the lower side will be described. Table 7 summarizes coordinates of surface vertices of optical surfaces constituting the imaging system 2*b* on the lower side.

TABLE 7

| | X | Y | Z | Angle |
|---|---|---|---|---|
| Light-emitting point group | 0.000 | −1.228 | −4.965 | 0.000 |
| Emission surface of substrate | 0.700 | 0.000 | 0.000 | 0.000 |
| Front surface of first lens | 5.271 | −1.228 | −4.591 | −4.244 |
| Lens substrate 1 | 6.171 | 0.000 | 0.000 | 0.000 |
| | 6.871 | 0.000 | 0.000 | 0.000 |
| Back surface of first lens | 7.764 | −1.228 | −4.406 | −4.244 |
| Aperture stop | 12.500 | −1.228 | −4.055 | 0.000 |
| Front surface of second lens | 16.323 | −1.228 | −3.786 | −4.244 |
| Lens substrate 2 | 17.223 | 0.000 | 0.000 | 0.000 |
| | 17.923 | 0.000 | 0.000 | 0.000 |
| Back surface of second lens | 18.817 | −1.228 | −3.601 | −4.244 |
| Protective cover | 19.300 | 0.000 | 0.000 | 0.000 |
| | 20.000 | 0.000 | 0.000 | 0.000 |
| Light-receiving surface | 22.722 | −1.228 | −3.323 | −7.639 |

Aspheric shapes in the imaging system 2*b* are summarized in Table 8.

TABLE 8

| i | Aspheric coefficient |
|---|---|
| Front surface of first lens 5d | |
| 2 | 9.40446E−02 |
| 4 | −1.90230E−04 |
| 6 | −7.60482E−04 |
| 8 | 5.89028E−04 |
| 10 | −1.24632E−04 |
| Back surface of first lens 5d | |
| 2 | −8.54951E−02 |
| 4 | 1.21150E−03 |
| 6 | −6.10419E−04 |
| 8 | 5.69473E−04 |
| 10 | −1.29972E−04 |
| Front surface of second lens 5f | |
| 2 | 9.68709E−02 |
| 4 | −2.43408E−03 |
| 6 | −2.14715E−03 |
| 8 | 5.80417E−04 |
| 10 | −1.06246E−04 |
| Back surface of second lens 5f | |
| 2 | −1.31309E−01 |
| 4 | 6.47926E−04 |
| 6 | −1.34121E−03 |
| 8 | 1.21849E−04 |
| 10 | 5.76222E−06 |

An optical system according to a second example is similar to the optical system according to the first example. However, the imaging system according to the second example is different from the imaging system according to the first example in that the imaging magnification β is −0.8. The photoreceptor has a radius and refractive index similar to those in the first embodiment. In the first example, since the imaging magnification β is −1, the angle between the optical axis AX and the light-emitting surface 3*f* corresponding to the light source surface are equal, in absolute value, to the angle between the optical axis AX and the light-receiving surface 71*a* corresponding to the photosensitive surface, but in the second example, the angle between the optical axis AX and the light-receiving surface 71*a* is obtained by multiplying the angle between the optical axis AX and the light-emitting surface 3*f* by 0.8.

Although no illustration is made, the number and arrangement of the light-emitting point groups DG in the second example are the same as those in the first example, but since the imaging magnification is different from that in the first example, and the size and interval are different. In the second example, for example, the light-emitting point ED has a diameter of 75 μm, which is 1.25 times that in the first example. In the main scanning direction, the light-emitting points ED are arranged at a pitch of 26.5 μm on the light-receiving surface 71*a* corresponding to the photoreceptor so as to achieve 1200 dpi. The minimum interval between the light-emitting points ED is still 10 μm, and thus, horizontal length slightly increases in terms of aspect ratio. When viewed at the center of the light-emitting point ED, the width in the main scanning direction is 1879 μm, the width in the sub-scanning direction is 242 μm, and the diameter of the light-emitting point ED is 75 μm. Accordingly, the full width is 1954 μm in the main scanning direction and 317 μm in the sub-scanning direction.

Note that, in the second example, the inclination of the optical axis AX relative to the light-emitting surface 3*f* corresponding to the light source surface is not equal to, that is, 0.8 times the inclination of the optical axis AX relative to the light-receiving surface 71*a* corresponding to the photosensitive surface, and in each of the imaging systems 2*b* and 2*c* on the upper and lower sides, the optical axis is inclined relative to that of the imaging system 2*a* at the center, and an imaging position or size on the light-receiving surface 71*a* is reduced in the sub-scanning direction. However, in this embodiment, the difference is 0.1% and a difference of width in the sub-scanning direction is approximately 0.2 μm, which is small as compared with other errors, and thus, there is no difference in the arrangement of the light-emitting points ED between the imaging systems on the upper and lower sides.

Figure 6:
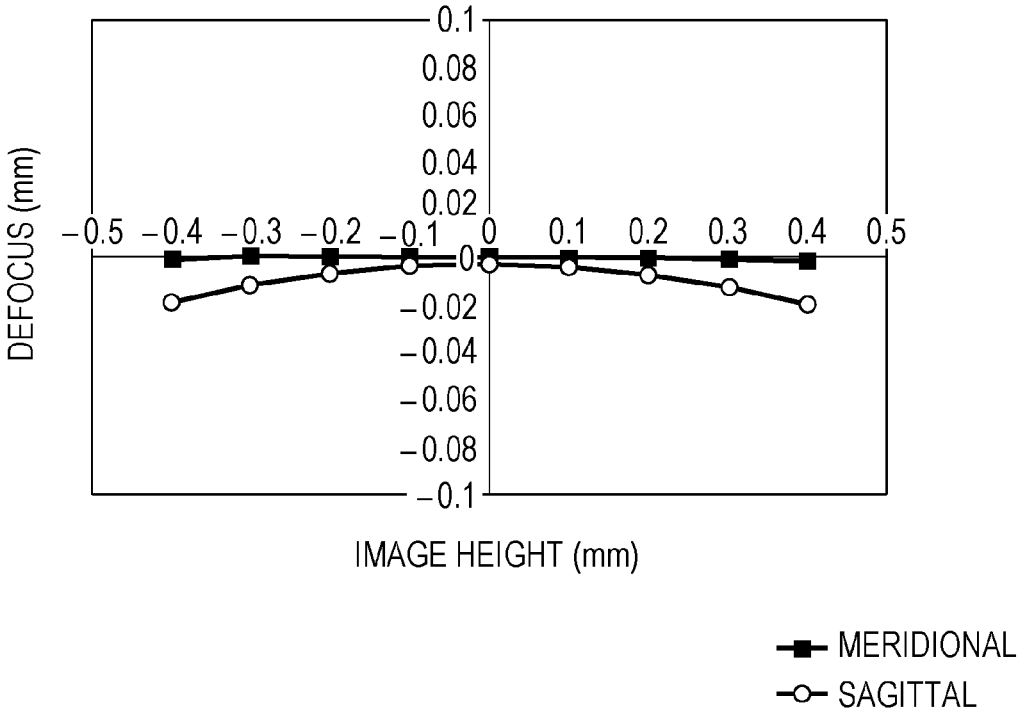
FIG. 6 illustrates field curvature in an imaging system on the lower side according to a second example.

FIG. 6 illustrates field curvature in the imaging system 2*b* on the lower side according to the second example. It can be seen that the optical axis AX appropriately inclined according to the magnification or distance relationship corrects the inclination of an image plane.

Second Embodiment

The image forming apparatus according to a second embodiment will be described below. The image forming apparatus according to a second embodiment is obtained by modifying the optical system 73*b* of the optical print head 73 of the image forming apparatus according to the first embodiment, and redundant description will be omitted.

Figure 7A:
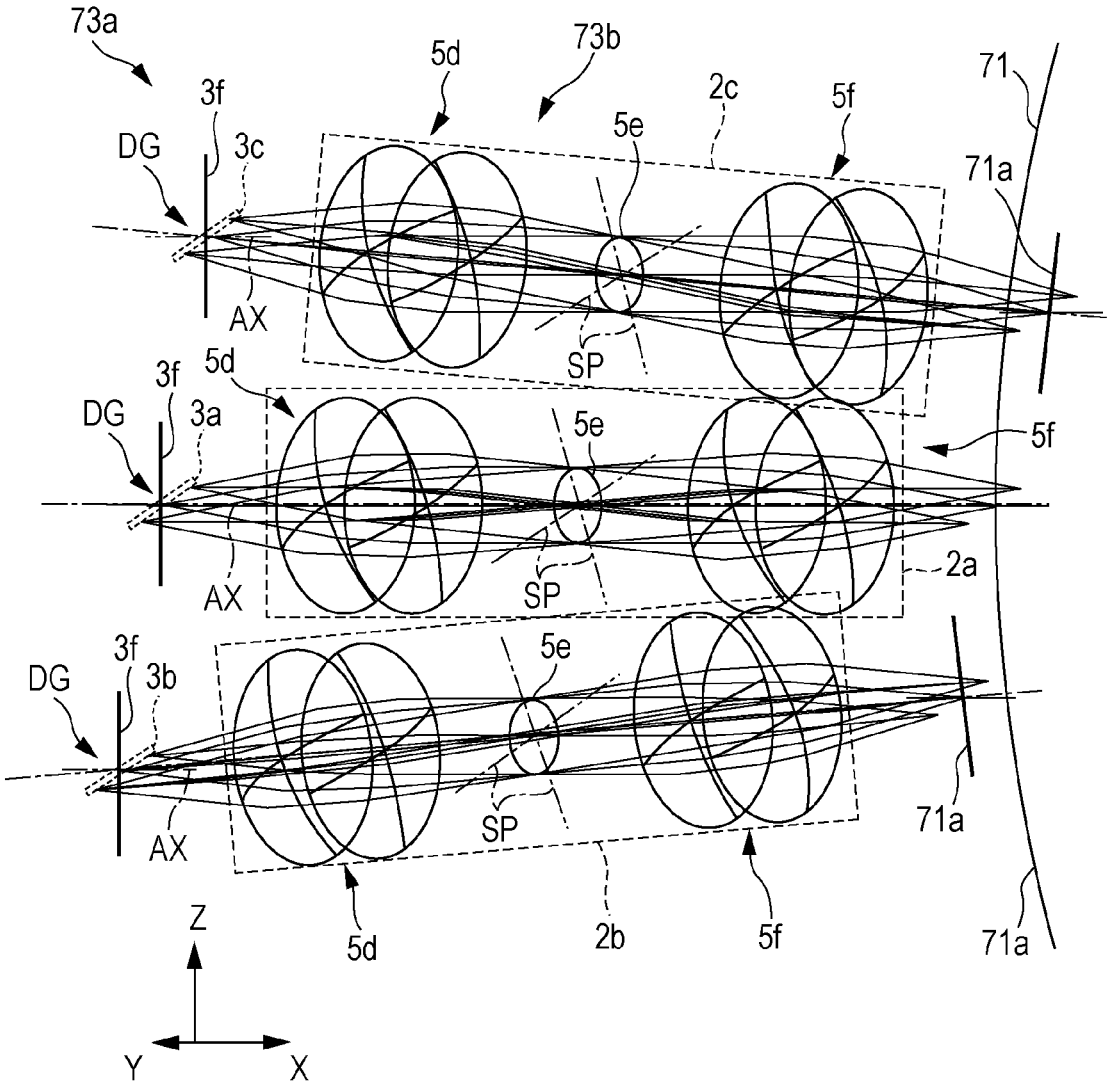
FIG. 7A is a side view of an optical print head incorporated in an image forming apparatus according to a second embodiment.

FIG. 7A is a diagram of the optical print head 73 incorporated in the image forming apparatus according to the second embodiment, which is a perspective view of the optical system 73*b*. A vertical direction in the drawing, that is, the Z direction represents the sub-scanning direction, but the main scanning direction is inclined between a horizontal direction and a vertical direction in the drawing. Actually, a large number of optical systems are arranged in the main scanning direction, but as in the first embodiment, only the imaging systems 2*a* to 2*c* are illustrated one-by-one in three rows in the sub-scanning direction. Furthermore, illustration of the lens substrate 5*h* is omitted, and the outlines of the lens surfaces and curves intersecting the two symmetrical planes SP are shown. It can be seen that curves intersecting the two symmetrical planes SP are inclined, and the y-axis and z-axis of local coordinates are inclined relative to the main scanning direction (Y direction) and the sub-scanning direction (Z direction). Only aperture shapes are illustrated as the aperture stops 5*e*. Each of the aperture stops 5*e* has actually circular shape but is viewed obliquely and illustrated as an ellipse. For each of the light-emitting point groups DG, the center thereof is illustrated as an intersection between a straight line passing through the center and extending in the main scanning direction and a straight line extending in the sub-scanning direction. At the center, light beam LB from the light-emitting point group DG is on the intersection of the symmetrical planes SP but is also shifted to the vertical scanning direction, at a position shifted to the main scanning direction. As for the light-receiving surface 71*a* which is a cylindrical surface of the photoreceptor drum 71, part of an arc in the sub-scanning direction is illustrated at a position where the light-receiving surface 71*a* intersects the optical axis AX of the imaging system 2*a* at the center. Furthermore, an intersection between the optical axis AX of each of the imaging systems 2*a* to 2*c* and the main scanning direction and the sub-scanning direction is represented by a cross shape on the optical axis AX. The sub-scanning direction indicates the direction of the tangent to the cylindrical surface of the light-receiving surface 71*a* and is relatively inclined in the imaging systems 2*b* and 2*c* on the upper and lower sides. Furthermore, similarly to the light source side, a light beam LB passing through a position shifted in the main scanning direction relative to the optical axis AX further passes through a position shifted in the sub-scanning direction.

In the illustrated optical system 73*b*, a free curved surface is used to match the sagittal and meridional image planes by using an optical system having two orthogonal symmetrical planes. In a case of using the free-form surfaces for the imaging systems 2*a* to 2*c*, coincidence in curvatures of the cross-sections in the two symmetrical planes SP facilitates manufacturing compared with using different curvatures. When the curvatures of the cross-sections coincide with each other, the imaging magnification in the vicinity of the axis is constant regardless of the direction, even if the free-form surfaces are used. Therefore, even if the imaging systems 2*a* to 2*c* turn around the optical axes AX and the symmetrical planes are inclined relative to the main scanning direction or the sub-scanning direction, the principle of the present invention can be similarly applied. In a case where the width of the light-emitting point group ED, where the light-emitting points ED are distributed is reduced instead of permitting the light-emitting point group DG to have an inclination in the main scanning direction by devising the arrangement of the light-emitting point groups DG or the light-emitting points ED, when rotating the imaging systems 2*a* to 2*c* around the optical axes AX to align the symmetrical planes SP of the free-form surface with the arrangement direction of the light-emitting points ED, an amount of deviation of the light-emitting points ED from the symmetrical planes SP of the free-form surface can be reduced. When the free-form surface having a symmetrical planes SP is used, good imaging performance can be obtained on the symmetrical planes SP, but side effects may occur at positions away from the symmetrical planes SP and imaging performance may deteriorate. In that case, by suppressing the amount of deviation from the symmetrical planes SP, better imaging performance can be obtained. On the other hand, inclination of the light-emitting point group DG in the main scanning direction means that the light-receiving surface 71*a* being the photoreceptor has a large width in the sub-scanning direction, and thus, use of a conventional imaging systems having the optical axes AX which are parallel to each other influences oblique incidence on the light-receiving surface 71*a*, and thus inclining the optical axis AX by using the technology of the present invention can effectively suppress inclination of an image plane relative to the photoreceptor.

Figure 7B:
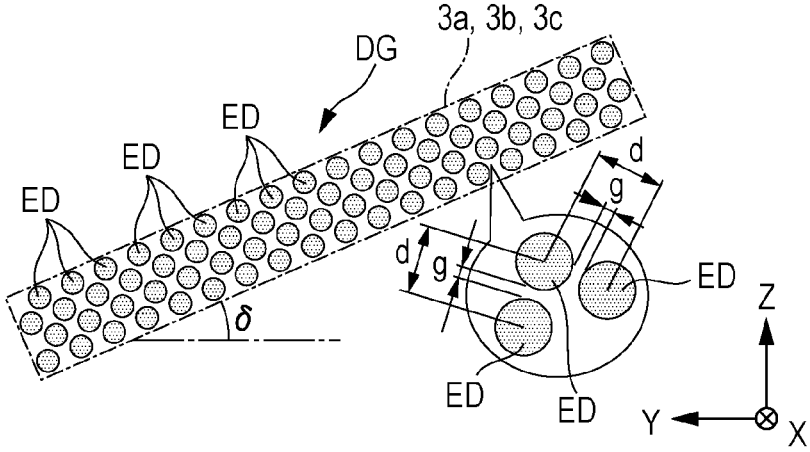
FIG. 7B is a diagram illustrating a light-emitting point group provided in a light-emitting element of the optical print head illustrated in FIG. 7A.

FIG. 7B is an enlarged view illustrating a specific arrangement of the light-emitting point group DG or the light-emitting points ED in the apparatus according to the second embodiment. In this case, the light-emitting point groups DG are arranged to be aligned to rectangular light-emitting areas 3*a*, 3*b*, 3*c* so as to be aligned with the long side. The light-emitting points ED constituting the light-emitting point group DG are arranged at equal intervals in the Y direction corresponding to the main scanning direction, and arranged at the same space cycle in the Z direction corresponding to the sub-scanning direction. A long side 16*a* of the rectangular shape of the light-emitting area 3*a* extends at a predetermined angle relative to the Y direction corresponding to the main scanning direction and the Z direction corresponding to the sub-scanning direction at a predetermined angle, at an angle δ relative to the horizontal main scanning direction, and the inclination direction of the light-receiving surface 71*a* to the rotation axis RX extends along one of the symmetrical planes SP of the imaging systems 2*a* to 2*c*.

Third Example

[3-a: Imaging System at Center]

Data on the imaging system 2*a* at the center will be described below. Table 9 summarizes coordinates of surface vertices of optical surfaces constituting the imaging system 2*a* at the center.

TABLE 9

| | X | Y | Z | x-axis angle | Rotation angle around x-axis |
|---|---|---|---|---|---|
| Light-emitting point group | 0.000 | 0.000 | 0.000 | 0.000 | 0.000 |
| Emission surface of substrate | 0.700 | 0.000 | 0.000 | 0.000 | 0.000 |
| Front surface of first lens | 3.941 | 0.000 | 0.000 | 0.000 | 23.756 |
| Lens substrate 1 | 4.841 | 0.000 | 0.000 | 0.000 | 0.000 |
| | 5.541 | 0.000 | 0.000 | 0.000 | 0.000 |
| Back surface of first lens | 6.441 | 0.000 | 0.000 | 0.000 | 23.756 |
| Aperture stop | 10.000 | 0.000 | 0.000 | 0.000 | 0.000 |
| Front surface of second lens | 13.759 | 0.000 | 0.000 | 0.000 | 23.756 |
| Lens substrate 2 | 14.659 | 0.000 | 0.000 | 0.000 | 0.000 |
| | 15.359 | 0.000 | 0.000 | 0.000 | 0.000 |
| Back surface of second lens | 16.259 | 0.000 | 0.000 | 0.000 | 23.756 |
| Protective cover | 16.700 | 0.000 | 0.000 | 0.000 | 0.000 |
| | 17.400 | 0.000 | 0.000 | 0.000 | 0.000 |
| Light-receiving surface | 20.000 | 0.000 | 0.000 | 0.000 | 0.000 |

Free-form shapes in the imaging system 2*a* are summarized in Table 10. The shape formula of the free-form surface described is the local coordinates corresponding to X, Y, Z as x, y, z (at x-axis angle 0, the direction matches the global coordinates X, Y, Z)

$$x = \sum_i \sum_j a_{i,1} \cdot y^j + z^i$$

Note that aspheric coefficients $a_{ij}$ not shown in the table are all zero. Hereinafter the same shall apply.

TABLE 10

| | i | | | | | |
|---|---|---|---|---|---|---|
| j | 0 | 2 | 4 | 6 | 8 | 10 |
| | | | Front surface of first lens 5d | | | |
| 0 | 0.00000E+00 | 1.20487E−01 | 1.27200E−03 | −7.26520E−04 | 5.46414E−04 | −8.62537E−05 |
| 2 | 1.20487E−01 | −2.50059E−03 | −2.17956E−03 | 2.18566E−03 | −4.31268E−04 | 0.00000E+00 |
| 4 | 1.27200E−03 | −2.17956E−03 | 3.27848E−03 | −8.62537E−04 | 0.00000E+00 | 0.00000E+00 |
| 6 | −7.26520E−04 | 2.18565E−03 | −8.62537E−04 | 0.00000E+00 | 0.00000E+00 | 0.00000E+00 |
| 8 | 5.46414E−04 | −4.31268E−04 | 0.00000E+00 | 0.00000E+00 | 0.00000E+00 | 0.00000E+00 |
| 10 | −8.62537E−05 | 0.00000E+00 | 0.00000E+00 | 0.00000E+00 | 0.00000E+00 | 0.00000E+00 |
| | | | Back surface of first lens 5d | | | |
| 0 | 0.00000E+00 | −1.09534E−01 | 5.48658E−03 | −1.45499E−03 | 9.07461E−04 | −1.45714E−04 |
| 2 | −1.09534E−01 | 9.42782E−03 | −4.36498E−03 | 3.62984E−03 | −7.28570E−04 | 0.00000E+00 |
| 4 | 5.48658E−03 | −4.36498E−03 | 5.44476E−03 | −1.45714E−03 | 0.00000E+00 | 0.00000E+00 |
| 6 | −1.45499E−03 | 3.62984E−03 | −1.45714E−03 | 0.00000E+00 | 0.00000E+00 | 0.00000E+00 |
| 8 | 9.07461E−04 | −7.28570E−04 | 0.00000E+00 | 0.00000E+00 | 0.00000E+00 | 0.00000E+00 |
| 10 | −1.45714E−04 | 0.00000E+00 | 0.00000E+00 | 0.00000E+00 | 0.00000E+00 | 0.00000E+00 |

TABLE 10-continued

| j | i 0 | 2 | 4 | 6 | 8 | 10 |
|---|---|---|---|---|---|---|
| | | | Front surface of second lens 5f | | | |
| 0 | 0.00000E+00 | 1.34653E−01 | −2.01886E−03 | 1.22978E−03 | −5.45641E−04 | 8.74909E−05 |
| 2 | 1.34653E−01 | −2.49237E−03 | 3.68934E−03 | −2.18256E−03 | 4.37455E−04 | 0.00000E+00 |
| 4 | −2.01886E−03 | 3.68934E−03 | −3.27385E−03 | 8.74909E−04 | 0.00000E+00 | 0.00000E+00 |
| 6 | 1.22978E−03 | −2.18256E−03 | 8.74909E−04 | 0.00000E+00 | 0.00000E+00 | 0.00000E+00 |
| 8 | −5.45641E−04 | 4.37455E−04 | 0.00000E+00 | 0.00000E+00 | 0.00000E+00 | 0.00000E+00 |
| 10 | 8.74909E−05 | 0.00000E+00 | 0.00000E+00 | 0.00000E+00 | 0.00000E+00 | 0.00000E+00 |
| | | | Back surface of second lens 5f | | | |
| 0 | 0.00000E+00 | −9.44828E−02 | 1.73989E−03 | 1.09346E−03 | −6.06572E−04 | 1.09095E−04 |
| 2 | −9.44828E−02 | 8.52438E−03 | 3.28037E−03 | −2.42629E−03 | 5.45473E−04 | 0.00000E+00 |
| 4 | 1.73989E−03 | 3.28037E−03 | −3.63943E−03 | 1.09095E−03 | 0.00000E+00 | 0.00000E+00 |
| 6 | 1.09346E−03 | −2.42629E−03 | 1.09095E−03 | 0.00000E+00 | 0.00000E+00 | 0.00000E+00 |
| 8 | −6.06572E−04 | 5.45473E−04 | 0.00000E+00 | 0.00000E+00 | 0.00000E+00 | 0.00000E+00 |
| 10 | 1.09095E−04 | 0.00000E+00 | 0.00000E+00 | 0.00000E+00 | 0.00000E+00 | 0.00000E+00 |

[3-b: Imaging System on Lower Side]

Hereinafter, data on the imaging system 2*b* on the lower side will be described. Table 11 summarizes coordinates of surface vertices of optical surfaces constituting the imaging system 2*b* on the lower side.

TABLE 11

| | X | Y | Z | x-axis angle | Rotation angle around x-axis |
|---|---|---|---|---|---|
| Light-emitting point group | 0.000 | −1.228 | −4.966 | 0.000 | 0.000 |
| Emission surface of substrate | 0.700 | 0.000 | 0.000 | 0.000 | 0.000 |
| Front surface of first lens | 3.941 | −1.228 | −4.701 | −4.086 | 23.703 |
| Lens substrate 1 | 4.841 | 0.000 | 0.000 | 0.000 | 0.000 |
| | 5.541 | 0.000 | 0.000 | 0.000 | 0.000 |
| Back surface of first lens | 6.435 | −1.228 | −4.523 | −4.086 | 23.703 |
| Aperture stop | 10.000 | −1.228 | −4.269 | 0.000 | 0.000 |
| Front surface of second lens | 13.759 | −1.228 | −4.000 | −4.086 | 23.703 |
| Lens substrate 2 | 14.659 | 0.000 | 0.000 | 0.000 | 0.000 |
| | 15.359 | 0.000 | 0.000 | 0.000 | 0.000 |
| Back surface of second lens | 16.252 | −1.228 | −3.822 | −4.086 | 23.703 |
| Protective cover | 16.700 | 0.000 | 0.000 | 0.000 | 0.000 |
| | 17.400 | 0.000 | 0.000 | 0.000 | 0.000 |
| Light-receiving surface | 20.254 | −1.228 | −3.553 | −8.171 | 0.000 |

Free-form shapes in the imaging system 2*b* are summarized in Table 12.

TABLE 12

| j | i 0 | 2 | 4 | 6 | 8 | 10 |
|---|---|---|---|---|---|---|
| | | | Front surface of first lens 5d | | | |
| 0 | 0.00000E+00 | 1.20105E−01 | 1.03155E−03 | −5.01768E−04 | 4.35115E−04 | −6.79071E−05 |
| 2 | 1.20105E−01 | 2.95117E−04 | −1.50530E−03 | 1.74046E−03 | −3.39536E−04 | 0.00000E+00 |
| 4 | 1.03155E−03 | −1.50530E−03 | 2.61069E−03 | −6.79071E−04 | 0.00000E+00 | 0.00000E+00 |
| 8 | −5.01766E−04 | 1.74046E−03 | −6.79071E−04 | 0.00000E+00 | 0.00000E+00 | 0.00000E+00 |
| 8 | 4.35115E−04 | −3.39536E−04 | 0.00000E+00 | 0.00000E+00 | 0.00000E+00 | 0.00000E+00 |
| 10 | −6.79071E−05 | 0.00000E+00 | 0.00000E+00 | 0.00000E+00 | 0.00000E+00 | 0.00000E+00 |
| | | | Back surface of first lens 5d | | | |
| 0 | 0.00000E+00 | −1.09187E−01 | 5.13509E−03 | −1.12857E−03 | 7.36581E−04 | −1.15787E−04 |
| 2 | −1.09187E−01 | 1.15522E−02 | −3.38570E−03 | 2.94624E−03 | −5.78933E−04 | 0.00000E+00 |
| 4 | 5.13509E−03 | −3.38570E−03 | 4.41937E−03 | −1.15787E−03 | 0.00000E+00 | 0.00000E+00 |
| 6 | −1.12857E−03 | 2.94624E−03 | −1.15787E−03 | 0.00000E+00 | 0.00000E+00 | 0.00000E+00 |

TABLE 12-continued

| j | i 0 | 2 | 4 | 6 | 8 | 10 |
|---|---|---|---|---|---|---|
| 8 | 7.36561E−04 | −5.78933E−04 | 0.00000E+00 | 0.00000E+00 | 0.00000E+00 | 0.00000E+00 |
| 10 | −1.15787E−04 | 0.00000E+00 | 0.00000E+00 | 0.00000E+00 | 0.00000E+00 | 0.00000E+00 |
| | | | Front surface of second lens 5f | | | |
| 0 | 0.00000E+00 | 1.04644E−01 | −5.13799E−03 | 1.12064E−05 | −2.22537E−04 | 1.88314E−05 |
| 2 | 1.04644E−01 | −1.15580E−02 | 3.36193E−05 | −8.90148E−04 | 9.41571E−05 | 0.00000E+00 |
| 4 | −5.13799E−03 | 3.36193E−05 | −1.33522E−03 | 1.88314E−04 | 0.00000E+00 | 0.00000E+00 |
| 6 | 1.12064E−05 | −8.90148E−04 | 1.88314E−04 | 0.00000E+00 | 0.00000E+00 | 0.00000E+00 |
| 8 | −2.225376−04 | 9.41571E−05 | 0.00000E+00 | 0.00000E+00 | 0.00000E+00 | 0.00000E+00 |
| 10 | 1.883146−05 | 0.00000E+00 | 0.00000E+00 | 0.00000E+00 | 0.00000E+00 | 0.00000E+00 |
| | | | Back surface of second lens 5f | | | |
| 0 | 0.00000E+00 | −1.23420E−01 | −1.34134E−03 | −1.18643E−04 | −1.70762E−04 | 2.18693E−05 |
| 2 | −1.23420E−01 | −9.14704E−04 | −3.55929E−04 | −6.83049E−04 | 1.09347E−04 | 0.00000E+00 |
| 4 | −1.34134E−03 | −3.55929E−04 | −1.02457E−03 | 2.18693E−04 | 0.00000E+00 | 0.00000E+00 |
| 6 | −1.18643E−04 | −6.83049E−04 | 2.18693E−04 | 0.00000E+00 | 0.00000E+00 | 0.00000E+00 |
| 8 | −1.70762E−04 | 1.09347E−04 | 0.00000E+00 | 0.00000E+00 | 0.00000E+00 | 0.00000E+00 |
| 10 | 2.18693E−05 | 0.00000E+00 | 0.00000E+00 | 0.00000E+00 | 0.00000E+00 | 0.00000E+00 |

An optical system according to a third example is similar to the optical system illustrated in FIG. 7A. The optical system according to the third example has an imaging magnification of −1, which is the same as that in the first example, but is different from the optical system in the first example, in that the lens surface does not have an axisymmetric aspherical surface but has a free-form surface. The free-form surface is defined by a binary polynomial, but as shown in Tables 10 and 12, any lens surface uses only even orders for the y and z directions and has a symmetrical shape in both the y and z directions. Furthermore, it can be found that for any lens surface, coefficients (i=2, j=0) of the second order of y axis and the zeroth order of z axis and coefficients (i=0, j=2) of the zeroth order of y axis and the second order of z axis are equal and the curvature near the local coordinate origin is equal in any direction. Each of the imaging systems 2*a* to 2*c* has four lens surfaces, but the origins of the local coordinates are aligned on a straight line, and all four x axis of the local coordinates of each lens surface are on the straight line. In addition, the xy planes of the local coordinates are in the same plane in the global coordinates, and the xz planes are also in the same plane. In other words, the xy plane and the xz plane described above are the symmetrical planes SP of the entire lens surface. The straight line at which the two symmetrical planes SP intersects is called the optical axis. Since the lens substrates 5*h* and 5*k* are common to all the imaging systems 2*a* to 2*c*, the optical axis AX is inclined relative to the lens substrates 5*h* and 5*k* in the imaging system 2*b* on the lower side, and only the four lens surfaces constituting the imaging system 2*b* has symmetry.

The light-emitting point group DG according to the third example is the light-emitting point group DG illustrated in FIG. 7B, and as in the first example, the light-emitting point ED has a diameter of 60 μm, light-emitting points ED have a minimum interval g of 10 μm, and a minimum center distance d of 70 μm. However, unlike the first example, the light-emitting point group DG according to the third example is inclined in the main scanning direction or the Y direction as a whole. When one of the light-emitting points ED in the lowermost row is selected, a light-emitting point on the right in the main scanning direction is separated by 21.2 μm in the main scanning direction, and the light-emitting points ED having a diameter of 60 μm are arranged at positions shifted in the sub-scanning direction to prevent overlapping each other, and the light-emitting points ED are shifted by 66.7 μm upward in the drawing to have the minimum interval g of 10 μm, as in the first and third examples. The difference is that the fourth light-emitting point is arranged immediately on the right side in the main scanning direction in the first example, whereas the light-emitting point is arranged to be shifted upward by 37.3 μm in the third example. This deviation is selected so that the minimum interval between the light-emitting points immediately on the right side and the fourth light-emitting point on the right side is 10 μm. Thus, as a whole, the light-emitting points are arranged into substantially a rectangular shape inclined at an angle δ of 23.76 degrees. At this time, the width of a short side of the rectangular shape is 218 μm and is narrower than the width 260 μm in the sub-scanning direction in the first example. In the third example, the imaging systems 2*a* to 2*c* are turned around the optical axis AX so that the long side direction of the inclined rectangular shape corresponds to the symmetrical planes SP of the free-form surface. In the imaging systems 2*a* to 2*c* using the free-form surfaces having the symmetrical planes SP, imaging performance tends to decrease at a position deviated from the symmetrical planes SP, and a configuration as in the third example can reduce the amount of deviation from the symmetrical planes SP. On the other hand, since the full width in the sub-scanning direction is 856 μm, if a conventional imaging system in which the optical axis AX is not inclined as in the third example is used, the imaging systems on the upper and lower sides is considered to suffer damage by the inclination of image planes due to inclination of the light-receiving surface 71*a*. The inclination of the light-emitting point group DG in the main scanning direction in the third example has no difference in the imaging system 2*a* at the center or in the imaging systems 2*b* and 2*c* on the upper and lower sides. Although the symmetrical planes SP of the imaging systems 2*a* to 2*c* are inclined according to the inclination of the light-emitting point group DG, but in the imaging systems 2*b* and 2*c* on the upper and lower sides the optical axes AX are inclined relative to the light-emitting surface 3*f*, and the rotation angles of the imaging systems 2*a* to 2*c* around the optical axes AX are slightly different between the imaging system 2*a* at the center and the imaging systems 2*b* and 2*c* on the upper and lower sides. In the imaging system 2*a* at the center, the rotation angle is 23.76 degrees, which is the same as the inclination of the light-emitting point group DG, while in the imaging systems 2*b* and 2*c* on the upper and lower sides, the rotation angle is 23.70 degrees, which is slightly smaller than the inclination of the light-emitting point group DG.

Figure 8:
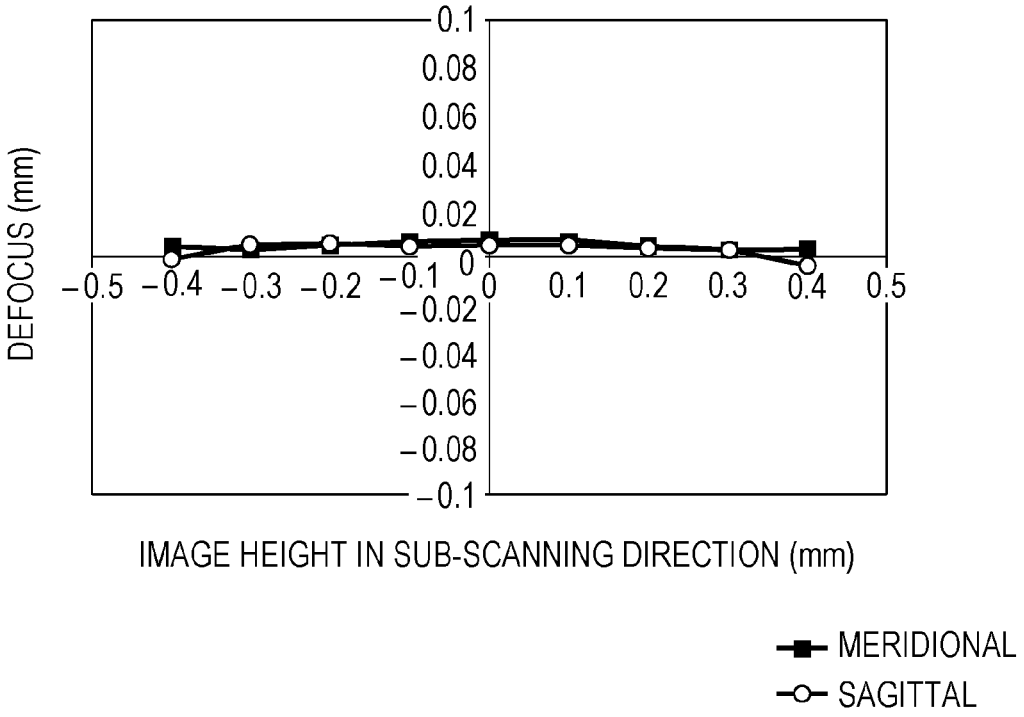
FIG. 8 illustrates field curvature in an imaging system on the lower side according to a third example.

FIG. 8 illustrates field curvature in the imaging system 2*b* on the lower side in the third example. It can be seen that the optical axis AX appropriately inclined according to the magnification or distance relationship corrects the inclination of an image plane. Although the horizontal axis indicates the image height in the sub-scanning direction, but calculation is performed by changing the position of an object point on the above-mentioned symmetrical planes SP, and the image height is inclined 23.76 degrees in the main scanning direction on the light-emitting surface 3*f*, and thus, when the image height in the sub-scanning direction is 0.4 mm, the corresponding object point is separated by about 1 mm from the optical axis AX.

Although the image forming apparatus and the optical print head as specific embodiments have been described above, the image forming apparatus according to the present invention is not limited to the above. For example, the number of imaging systems constituting the optical system 73*b* is not limited to three and may be two or four or more.

The imaging systems 2*a* to 2*c* are not limited to the lens configuration of two sheets and may have lens configuration of three or more.

According to an embodiment of the present invention, the following conditional expression (1) is established in the image forming apparatus.

$$0.90 \leq y/(h+(1-\beta)r) \leq 1.1\theta \quad (1)$$

However,

θ is an angle between a line normal to a flat surface formed by the light-emitting point group and the optical axis of the imaging system, y is a distance from a foot of the line extending from a rotational symmetry axis and normal to the flat surface formed by the light-emitting point group, to a position at which the optical axis intersects the flat surface formed by the light-emitting point group, in a plane perpendicular to the rotational symmetry axis of the light-receiving surface, h is a distance, in the line extending from the rotational symmetry axis and normal to the flat surface formed by the light-emitting point group, from a position where the line intersects the light-receiving surface to a position where the line intersects the flat surface formed by the light-emitting point group, β is an imaging magnification of the imaging system, and r is a radius of a cylindrical shape of the light-receiving surface.

In this case, an angle θ between an optical axis and a line normal to a flat surface formed by a light-emitting point group can be made closer to an angle between the optical axis and a line normal to the light-receiving surface, inclination of an image plane of an imaging system can be made closer to inclination of the light-receiving surface, and thus an imaging state is improved.

According to still another embodiment of the present invention, sets of the light-emitting point groups and the imaging systems include three adjacent light-emitting point groups and three imaging systems corresponding thereto. In this case, light utilization efficiency can be enhanced.

According to still another embodiment of the present invention, a light-emitting element includes an organic EL device. The organic EL device enables high-density arrangement of light-emitting point groups over a wide area.

According to yet another embodiment of the present invention, each of the imaging systems has a rotationally symmetrical shape. This configuration facilitates manufacture and assembly of the imaging system.

According to yet another embodiment of the present invention, each of the imaging systems is symmetrical about two orthogonal planes. This configuration facilitates manufacture and assembly of the imaging system.

According to yet another embodiment of the present invention, the imaging system has a free-form surface having two symmetrical planes, and cross-sectional shapes of the two symmetrical planes have curvatures equal to each other in the vicinity of a straight line where the two symmetrical planes intersect each other. In this case, symmetry can be enhanced in two orthogonal image height directions, and an imaging state on the light-receiving surface can be improved.

In still another embodiment of the present invention, each light-emitting point group is arranged in substantially a parallelogram area. In this case, light-emitting points constituting the light-emitting point groups are gradually shifted in a main scanning direction and sub-scanning direction into a high-density arrangement.

According to still another embodiment of the present invention, the light-emitting point group is arranged in substantially a rectangular area, the area has long sides not parallel to the rotational symmetry axis, and one of the two symmetrical planes is substantially parallel to the long sides. This configuration provides not only high-density arrangement in which the light-emitting points constituting the light-emitting point groups are gradually shifted in a main scanning direction and sub-scanning direction but also preferably increased symmetry of the imaging state on the light-receiving surface.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a light-emitting element that includes light-emitting point groups arranged two-dimensionally; and an optical system that includes imaging systems focusing light from light-emitting points of the light-emitting point groups, on different positions on a light-receiving surface, wherein the light-emitting point groups and the imaging systems are combined into a plurality of sets, the light-receiving surface has a cylindrical shape, each of the imaging systems has a negative imaging magnification, a plurality of light-emitting point groups provided adjacently in a main scanning direction in the light-emitting element is arranged at different positions in the main scanning direction and in a sub-scanning direction corresponding to the main scanning direction, the imaging systems adjacent to each other have optical axes non-parallel to each other having different angles according to positions in the sub-scanning direction when viewed in a direction of a rotation axis of the light receiving surface, when a central normal passing through the center of each of the light-emitting point groups is not perpendicular to the light-receiving surface, each of the optical axes has an angle being not zero relative to the central normal, and a plane including the optical axis and the central normal is perpendicular to a rotational symmetry axis corresponding to the rotation axis of the light-receiving surface, and an angle between the optical axis and a line normal to the light-receiving surface at a point of intersection between the optical axis and the light-receiving surface is smaller, in absolute value, than an angle between the central normal and a line normal to the light-receiving surface at a point of intersection between the central normal and the light-receiving surface, and the angles are directed in the same direction.

2. The image forming apparatus according to claim 1, wherein the following conditional expression (1) is established:

$$0.90 \leq y/(h+(1-\beta)r) \leq 1.1\theta$$

where,

θ is an angle between a line normal to a flat surface formed by the light-emitting point group and the optical axis of the imaging system, y is a distance from a foot of the line extending from a rotational symmetry axis and normal to the flat surface formed by the light-emitting point group, to a position at which the optical axis intersects the flat surface formed by the light-emitting point group, in a plane perpendicular to the rotational symmetry axis of the light-receiving surface, h is a distance, in the line extending from the rotational symmetry axis and normal to the flat surface formed by the light-emitting point group, from a position where the line intersects the light-receiving surface to a position where the line intersects the flat surface formed by the light-emitting point group, β is an imaging magnification of the imaging system, and r is a radius of a cylindrical shape of the light-receiving surface.

3. The image forming apparatus according to claim 1, wherein the angle between the optical axis and the line normal to the light-receiving surface at the point of intersection between the optical axis and the light-receiving surface is obtained by multiplying an angle θ between the optical axis and the line normal to the flat surface formed by the light-emitting point group by an absolute value of an imaging magnification β.

4. The image forming apparatus according to claim 1, wherein the sets of the light-emitting point groups and the imaging systems include three adjacent light-emitting point groups and three imaging systems corresponding thereto.

5. The image forming apparatus according to claim 1, wherein the light-emitting element includes an organic EL device.

6. The image forming apparatus according to claim 1, wherein each of the imaging systems has a rotationally symmetrical shape.

7. The image forming apparatus according to claim 1, wherein each of the imaging systems is symmetrical about two orthogonal planes.

8. The image forming apparatus according to claim 7, wherein the imaging system has a free-form surface having two symmetrical planes, and cross-sectional shapes of the two symmetrical planes have curvatures equal to each other in the vicinity of a straight line where the two symmetrical planes intersect each other.

9. The image forming apparatus according to claim 8, wherein the light-emitting point group is arranged in substantially a rectangular area, the area has a long side not parallel to the rotational symmetry axis, and one of the two symmetrical planes is substantially parallel to the long side.

10. The image forming apparatus according to claim 1, wherein each light-emitting point group is arranged in substantially a parallelogram area.

11. The image forming apparatus according to claim 10, wherein the area has opposite sides parallel to each other about the rotational symmetry axis.

* * * * *